US010317836B2

(12) United States Patent
Tokuma

(10) Patent No.: US 10,317,836 B2
(45) Date of Patent: Jun. 11, 2019

(54) SHEET STACKING APPARATUS AND AN IMAGE FORMING APPARATUS

(71) Applicant: CANON KABUSHIKI KAISHA, Tokyo (JP)

(72) Inventor: Naoto Tokuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/437,832

(22) Filed: Feb. 21, 2017

(65) Prior Publication Data

US 2017/0255156 A1 Sep. 7, 2017

(30) Foreign Application Priority Data

Mar. 1, 2016 (JP) ..... 2016-038572

(51) Int. Cl.
*B65H 31/20* (2006.01)
*G03G 15/00* (2006.01)
(Continued)

(52) U.S. Cl.
CPC ..... *G03G 15/6552* (2013.01); *B65H 31/02* (2013.01); *B65H 31/20* (2013.01); *B65H 31/22* (2013.01); *B65H 2301/4212* (2013.01); *B65H 2402/343* (2013.01); *B65H 2402/64* (2013.01); *B65H 2405/1119* (2013.01); *B65H 2405/11164* (2013.01); *B65H 2405/121* (2013.01); *B65H 2701/11312* (2013.01);
(Continued)

(58) Field of Classification Search
CPC ..... B65H 31/20; B65H 2405/11164; B65H 2405/111646
See application file for complete search history.

(56) References Cited

U.S. PATENT DOCUMENTS 7,463,860 B2 12/2008 Nobe et al.
7,510,180 B2 3/2009 Jang et al.
(Continued)

FOREIGN PATENT DOCUMENTS

CN 1727268 A 2/2006
CN 1760099 A 4/2006
(Continued)

OTHER PUBLICATIONS

European Search Report issued in corresponding European Application No. 17158312.3 dated Jul. 14, 2017.
(Continued)

*Primary Examiner* — Luis A Gonzalez
(74) *Attorney, Agent, or Firm* — Venable LLP

(57) ABSTRACT

Disclosed is a sheet stacking apparatus which includes a first stacking portion on which a sheet is stacked, a second stacking portion which is movable with respect to the first stacking portion, a third stacking portion which is detachably attachable to the first stacking portion or the second stacking portion and a restricting portion which restricts disengagement of the third stacking portion which has been attached. The second stacking portion is movable such that the second stacking portion is located at a first position where the restricting portion does not restrict disengagement of the third stacking portion and a second position where the restricting portion restricts disengagement of the third stacking portion which has been attached.

13 Claims, 19 Drawing Sheets

(51) Int. Cl.
*B65H 31/02* (2006.01)
*B65H 31/22* (2006.01)

(52) U.S. Cl.
CPC ..... *B65H 2801/06* (2013.01); *B65H 2801/27* (2013.01); *G03G 2215/00421* (2013.01)

(56) References Cited

U.S. PATENT DOCUMENTS

| | | | | |
|---|---|---|---|---|
| 8,430,399 | B1 * | 4/2013 | Huang | B65H 1/04 271/171 |
| 8,448,942 | B2 | 5/2013 | Otani et al. | |
| 8,613,442 | B2 | 12/2013 | Gamo et al. | |
| 8,752,837 | B2 | 6/2014 | Iwata et al. | |
| 8,794,617 | B2 | 8/2014 | Tokuma | |
| 8,851,468 | B2 | 10/2014 | Tokuma | |
| 9,067,753 | B2 | 6/2015 | Tokuma et al. | |
| 9,102,497 | B2 | 8/2015 | Tokuma | |
| 9,242,827 | B2 | 1/2016 | Niimura | |
| 9,598,257 | B2 * | 3/2017 | Komuro | B65H 31/20 |
| 2006/0018693 | A1 | 1/2006 | Nobe et al. | |
| 2006/0180994 | A1 | 8/2006 | Jang et al. | |
| 2009/0309294 | A1 | 12/2009 | Sugizaki et al. | |
| 2010/0111583 | A1 | 5/2010 | Fujita | |
| 2011/0285077 | A1 | 11/2011 | Otani et al. | |
| 2012/0275839 | A1 | 11/2012 | Kushida et al. | |
| 2012/0288310 | A1 | 11/2012 | Kamiya et al. | |
| 2013/0009360 | A1 | 1/2013 | Ma | |
| 2014/0167349 | A1 | 6/2014 | Niimura | |
| 2016/0159588 | A1 * | 6/2016 | Mizuguchi | B65H 31/26 271/147 |
| 2017/0036879 | A1 | 2/2017 | Tokuma | |
| 2017/0036880 | A1 | 2/2017 | Tokuma | |
| 2017/0036881 | A1 | 2/2017 | Tokuma | |

FOREIGN PATENT DOCUMENTS

| | | | |
|---|---|---|---|
| CN | 101734496 | A | 6/2010 |
| CN | 102248812 | A | 11/2011 |
| CN | 104854007 | A | 8/2015 |
| JP | 09-175712 | A | 7/1997 |
| JP | H09-278259 | A | 10/1997 |
| JP | 2002-114434 | A | 4/2002 |
| JP | 2010030773 | A * | 2/2010 |

OTHER PUBLICATIONS

Mar. 4, 2019 Chinese Official Action in Chinese Patent Appln. No. 201710105758.5.

* cited by examiner

SHEET STACKING APPARATUS AND AN IMAGE FORMING APPARATUS

BACKGROUND OF THE INVENTION

Field of the Invention

The present invention relates to a sheet stacking apparatus in which a sheet is stacked and to an image forming apparatus having the sheet stacking apparatus.

Description of the Related Art

The maximum length of a sheet which a user uses in a sheet conveying direction was previously about 19 inches. However, the demand for a sheet which is called "a long sheet" with a length of 26 to 30 inches (=660.4 to 762 mm) has been increasing as diversification progresses. In a case where such a sheet is used, when the length of a stacking tray is much less than the length of the sheet, the sheet may fall from the stacking tray. Thus, in order to stack a long sheet with the length of 30 inches, it is necessary for the stacking tray to have the length of about 30 inches.

On the other hand, since a user of a long sheet does not always use a long sheet, it is wasteful that the tray with the length of 30 inches occupies a user area. Thus, it is desirable that an extension tray for a long sheet has such a configuration that the extension tray can be detached or stored by a user and the extension tray can be used only when necessary.

For this reason, an extension tray for stacking discharged sheets that is provided in a detachably attachable manner has been proposed. In the configuration of such an extension tray, a leg portion for attachment is provided on a paper supporter made of a wire member and is configured to be inserted into a sheet discharging portion of an electronic device (Japanese Patent Laid-Open Application No. H9-278259).

When the extension tray is configured to be detachably attachable, it is desirable for the extension tray to be easily attached or detached. However, when the extension tray is configured to be easily attached or detached, a problem occurs in which the extension tray may unexpectedly come off.

On the other hand, when the extension tray is configured not to unexpectedly come off after having been attached, the operability of attaching and detaching of the extension tray becomes low.

SUMMARY OF THE INVENTION

The present invention provides a sheet stacking apparatus in which a sheet stacking portion is easily attached and detached and the sheet stacking portion is hard to come off during operation, and an image forming apparatus therewith.

A sheet stacking apparatus of the present invention, comprises:

a first stacking portion on which a sheet is stacked;

a second stacking portion on which a sheet is stacked, the second stacking portion being movable with respect to the first stacking portion;

a third stacking portion on which a sheet is stacked, the third stacking portion being detachably attachable to the first stacking portion or the second stacking portion; and a restricting portion which restricts disengagement of the third stacking portion which has been attached, wherein the second stacking portion is movable such that the second stacking portion is located at a first position and a second position; and wherein the restricting portion does not restrict disengagement of the third stacking portion when the second stacking portion is located at the first position and the restricting portion restricts disengagement of the third stacking portion which has been attached when the second stacking portion is located at the second position.

Further features of the present invention will become apparent from the following description of exemplary embodiments with reference to the attached drawings.

DESCRIPTION OF THE EMBODIMENTS

A sheet stacking apparatus according to embodiments of the present invention will be explained as an image forming apparatus including the sheet stacking apparatus with reference to the drawings. The image forming apparatus according to the embodiments of the present invention is a copying machine, a printer, a facsimile, or a multi-function machine thereof and has a sheet processing apparatus capable of aligning sheets discharged to a sheet stacking portion in the sheet discharging direction.

First Embodiment

<Overall Configuration of the Image Forming Apparatus>

Figure 1:
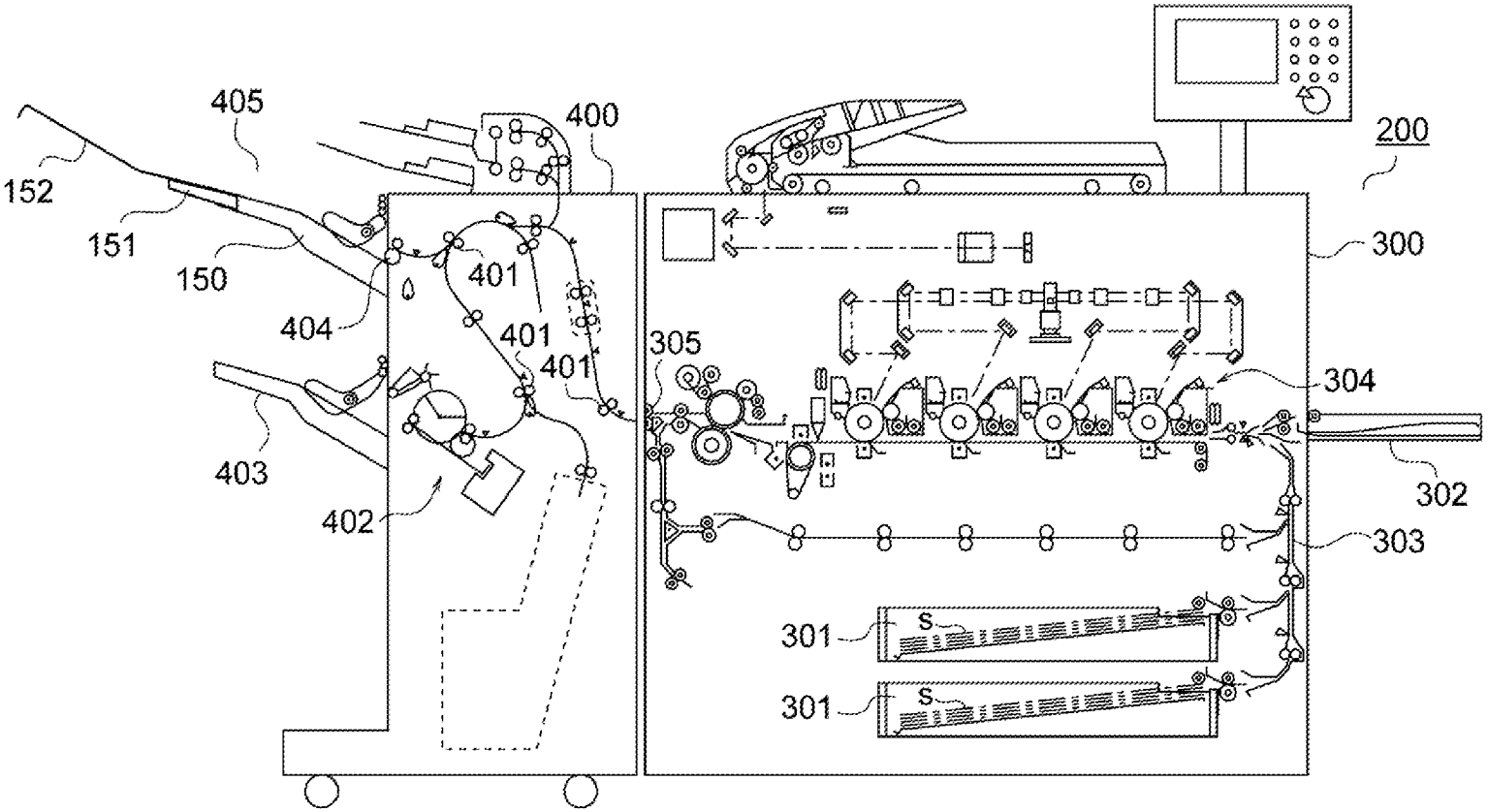
FIG. 1 is a schematic explanatory diagram of an image forming apparatus having a sheet processing apparatus according to an embodiment of the present invention.

FIG. 1 is a diagram of a cross-sectional view schematically showing the configuration of the image forming apparatus 200 according to an embodiment of the present invention. The configuration of the image forming apparatus will be described based the flow of a sheet.

As shown in FIG. 1, the image forming apparatus 200 includes the image forming apparatus main body 300 which forms an image on the sheet S, and the sheet processing apparatus 400. The sheet processing apparatus 400 according to the present embodiment is configured to be detachably attachable to the image forming apparatus main body 300 and can be used as an option for the image forming apparatus main body 300 which can also be used alone.

The sheet cassette 301 is loaded in the lower portion of the image forming apparatus main body 300, and the manual feed tray 302 is provided in the side portion of the image forming apparatus main body 300. The sheet S set on the sheet cassette 301 or the manual feed tray 302 is conveyed to the image forming unit 304 by the sheet feeding unit 303 including conveying rollers.

The image forming unit 304 of the present embodiment employs an electro-photographic system in which toner images of respective colors of yellow, magenta, cyan, and black formed on a photosensitive drum are sequentially transferred onto a conveyed sheet where the transferred toner image is heated and fixed.

The sheet on which the toner image is transferred and fixed by the image forming unit 304 is conveyed to the sheet processing apparatus 400 by the discharging roller 305. The sheet processing apparatus 400 is mounted on the downstream side in the sheet conveying direction of the image forming apparatus main body 300. The sheet processing apparatus 400 conveys a plurality of sheets S fed from the image forming apparatus main body 300 to the stapler unit 402 by the conveying roller 401 where the sheets are stapled and they are discharged to the lower discharging portion 403.

Further, the sheet processing apparatus 400 can discharge a conveyed sheet to the upper discharge portion 405 by the discharging roller 404 without diverting the conveyed sheet and performing the stapling process for the sheet.

<Configuration of the Sheet Stacking Apparatus>

Next, the sheet stacking apparatus which is a characterizing portion of the image forming apparatus of the present embodiment will be described. Here, an example will be explained in which the sheet stacking apparatus is applied to the upper discharging portion 405 for stacking sheets discharged from the sheet processing apparatus 400.

As shown in FIG. 1, in the upper discharging portion 405 of the present embodiment, the upper stacking tray 150 is provided, which is fixed to a side surface of the sheet processing apparatus 400. On the upper stacking tray 150, the slide tray 151 which is slidably movable is provided. The slide tray 151 is configured to be slidable from the storage position hidden below the lower surface of the upper stacking tray 150 to the position where the slide tray 151 protrudes downstream in the sheet discharging direction. Normally, the slide tray 151 is stored on the lower surface of the upper stacking tray 150. However, when a long sheet is discharged, the sheet stacking face is widened and a long sheet can be stacked by drawing out the slide tray 151 from the upper stacking tray 150.

Furthermore, in the present embodiment, the extension tray 152 can be attached on the slide tray 151 so that long sheets can be stacked without dropping from the stacking portion. Namely, the sheet stacking apparatus of the present embodiment has the upper stacking tray 150 which is the first stacking portion capable of stacking sheets, the slide tray 151 which is the second stacking portion and the extension tray 152 which is the third stacking portion.

The extension tray 152 is configured to be detachably attachable so as to be used only when discharging a long sheet. In the sheet stacking apparatus of the present embodiment, the extension tray 152 is configured to be easy to attach and detach and to be hard to fall off when attached. Hereinafter, the configuration for attaching the extension tray 152 will be described with reference to FIGS. 2 to 7.

Figure 2:
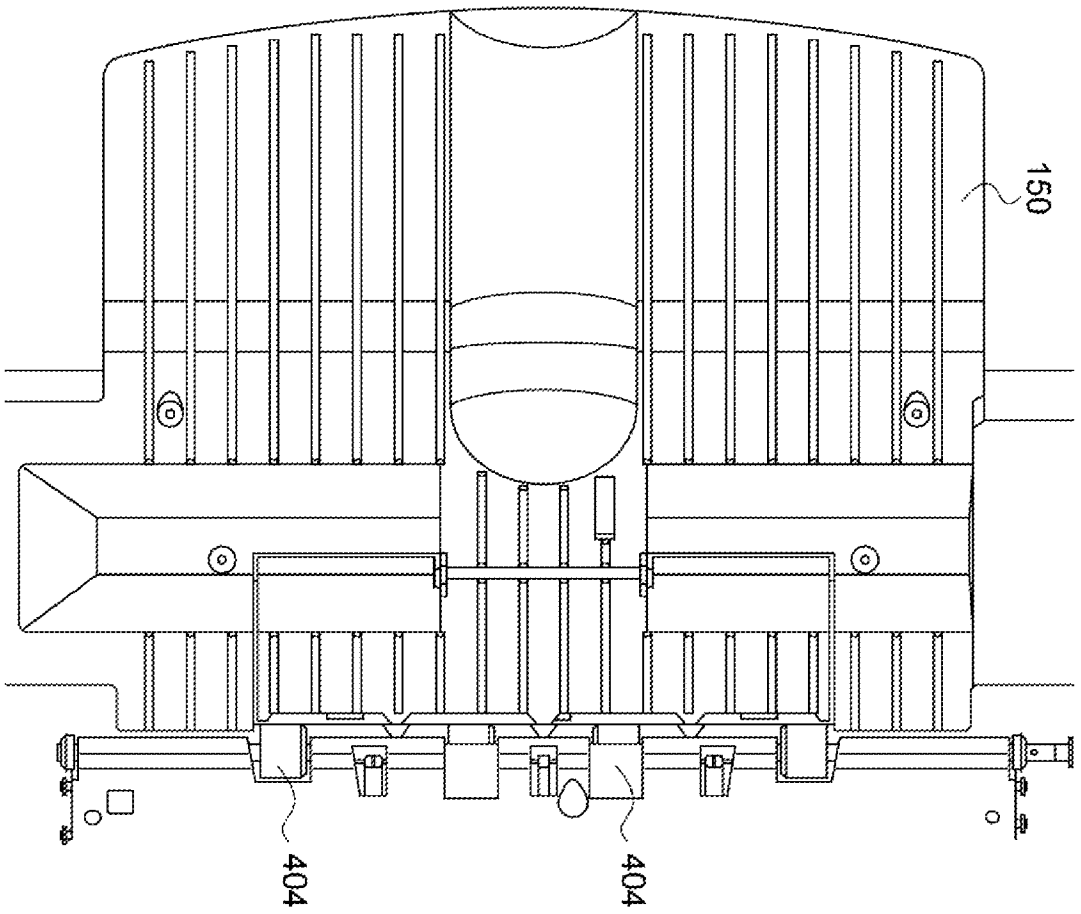
FIG. 2 is an explanatory diagram showing the state in which a side tray is stored in an upper stacking tray according to the first embodiment.
Figure 3A:
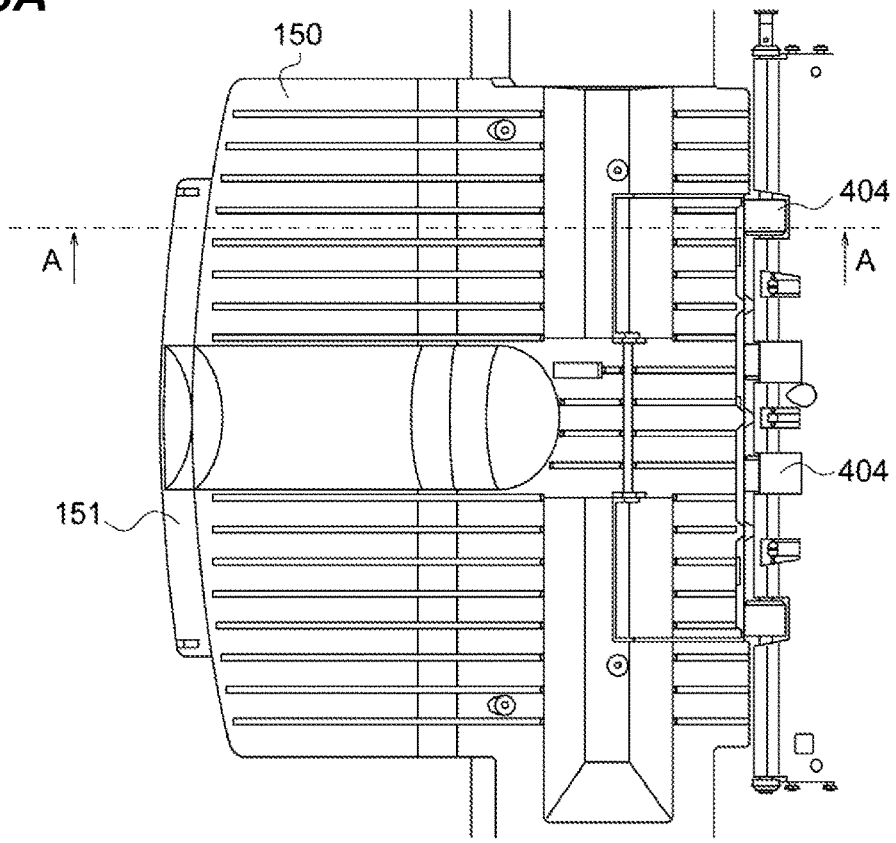
FIGS. 3A and 3B are explanatory diagrams showing the state in which the slide tray is drawn a little from the upper stacking tray according to the first embodiment.
Figure 3B:
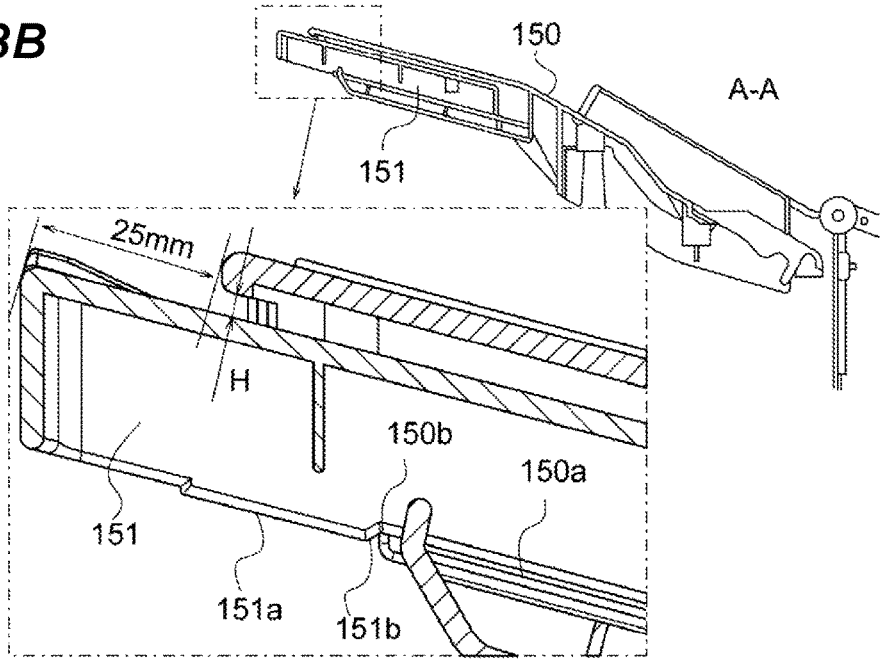

FIG. 2 shows the state in which the slide tray 151 is completely stored in the stacking tray 150. From this state, the slide tray 151 stored in the upper stacking tray 150 is drawn a little (about 25 mm) out so that the state shown in FIG. 3A is obtained. Before drawing out the slide tray 151, as shown in FIG. 3B, the abutting portion 151*a* for abutting in a vertical direction abuts against the rail portion 150*a* of the upper stacking tray 150 and the slide tray 151 is slidably supported. When the slide tray 151 is drawn out by about 25 mm, the slope 151*b* for holding the slide tray 151 shown in FIG. 3B abuts against the holding portion 150*b* of the upper stacking tray 150 due to its own weight thereby holding the slide tray 151.

Figure 4A:
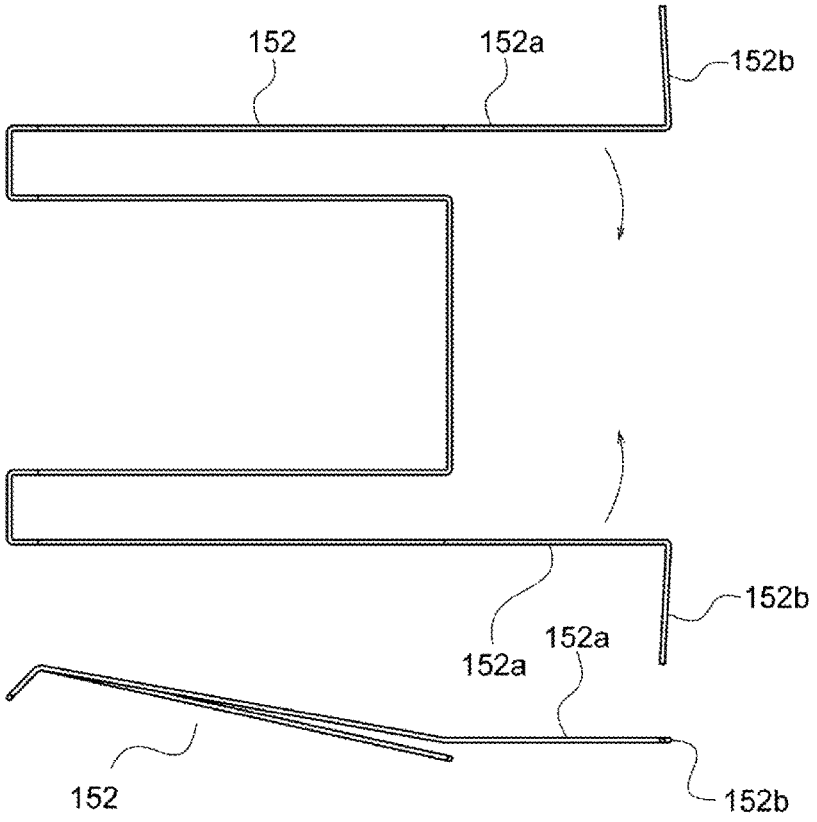
FIGS. 4A and 4B are explanatory diagrams of an extension tray according to the first embodiment.
Figure 4B:
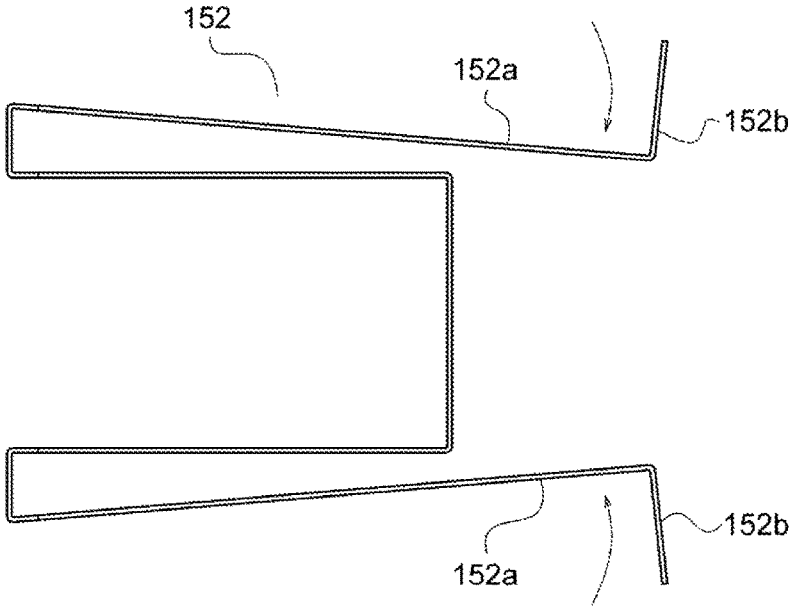

As shown in FIGS. 4A and 4B, the extension tray 152 is formed by bending an elastically deformable wire rod member. When attaching the extension tray 152, the leg portion 152*a* is bent in the direction shown by the arrow in FIGS. 4A and 4B from the state of FIG. 4A to the state of FIG. 4B. Thereafter, the extension tray 152 is inserted into the gap H (refer to FIG. 3B) between the upper stacking tray 150 and the slide tray 151. Thereafter, the bend of the extension tray 152 is released, and the posture for attachment of the extension tray 152 (the state of FIG. 4A) is achieved. Since the extension tray 152 is a wire-like member, it has a low elastic coefficient and is easily bent.

Figure 5:
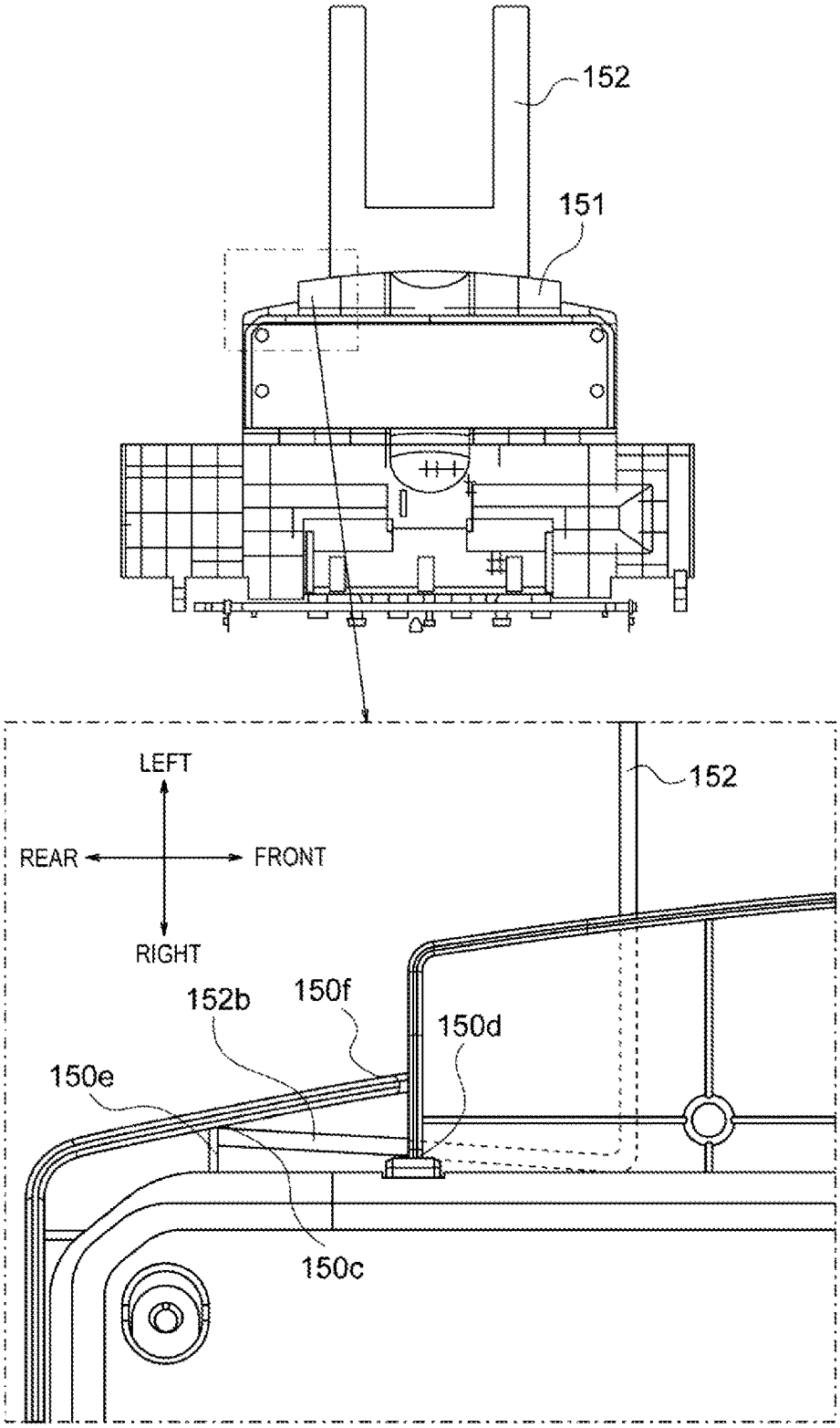
FIG. 5 is an explanatory diagram showing the attaching of the extension tray according to the first embodiment.

FIG. 5 is a diagram of a view showing the attaching portion of the extension tray 152 as viewed from the back side of the stacking surface. After the extension tray 152 is attached, the movement of the extension tray 152 in the vertical direction is restricted by the extension tray 152 being caught in the gap between the upper stacking tray 150 and the slide tray 151. The movement of the extension tray 152 in the left and right directions is restricted by the engaging portion 152*b* of the extension tray 152 being caught between the first left and right direction restricting portion 150*c* and the second left and right direction restricting portion 150*d* of the upper stacking tray 150. That is, as shown in FIG. 5, the first left and right direction restricting portion 150*c* and the second left and right direction restricting portion 150*d* are formed on the upper stacking tray 150. When the extension tray 152 is inserted into the gap between the upper stacking tray 150 and the slide tray 151 and the bend of the leg portion 152*a* is released, the engaging portion 152*b* is engaged with the first left and right restricting portion 150*c* and the second left and right restricting portion 150*d* thereby restricting the movement in the right and left directions is restricted. Further, the movement in the front and rear directions is restricted by the extension tray 152 being caught between the thrust restricting portions 150*e* formed on the front side and the far side of the upper stacking tray 150. In this state, the temporary fixation of the extension tray 152 is completed.

The extension tray 152 is bent inward as shown in FIG. 4B and then inserted in order to prevent interference with the outer wall portion 150*f* (refer to FIG. 5) of the upper stacking tray 150.

<Restricting Portion>

As described above, since the extension tray 152 is easy to bend, the extension tray 152 may disengage when a force that causes the bend depicted in FIG. 4B is applied in this state. Therefore, in the present embodiment, as described below, a restricting portion is provided at a predetermined position of the slide tray 151 for restricting the disengagement of the attached extension tray 152.

Figure 6A:
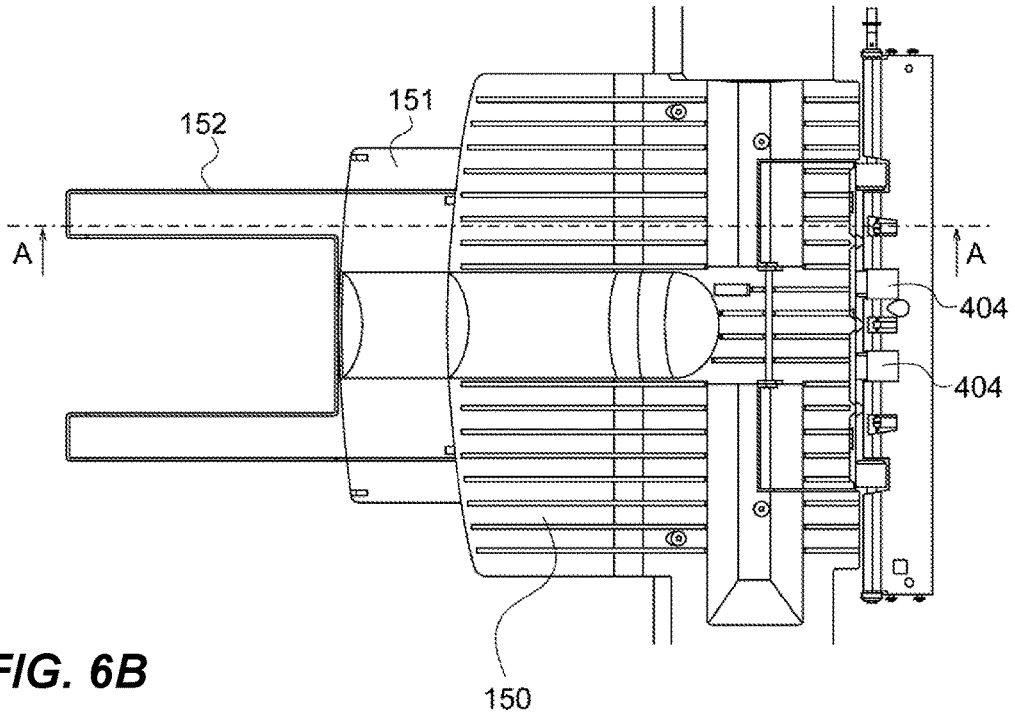
FIGS. 6A and 6B are explanatory diagrams showing the state in which the extension tray according to the first embodiment is attached.
Figure 6B:
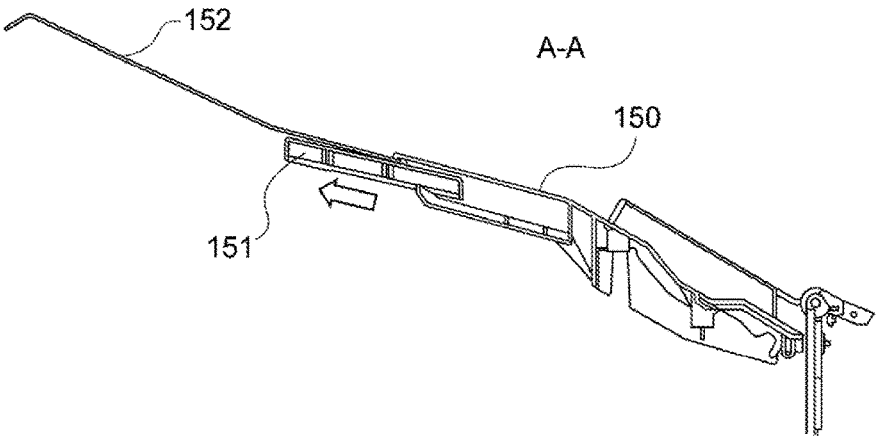
Figure 7:
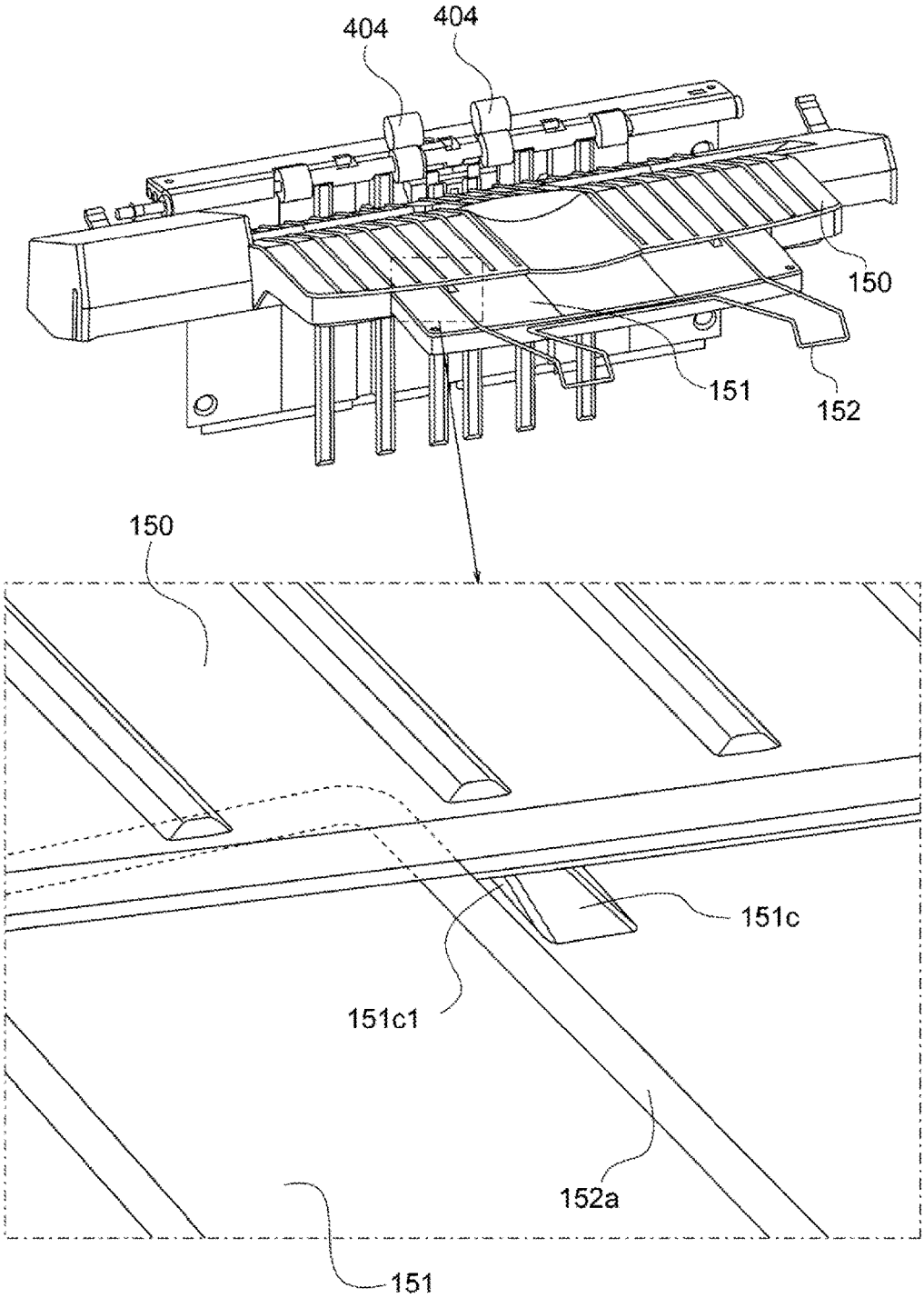
FIG. 7 is an explanatory diagram showing a restricting portion which restricts the detaching of the extension tray according to the first embodiment.

As shown in FIG. 6, after attaching the extension tray 152, the slide tray 151 is completely drawn out in the direction of the arrow in FIG. 6B. When the slide tray 151 is completely drawn out, the protruding portion 151*c* as the restricting portion, which protrudes from the slide tray 151 is formed on the slide tray 151 so that the protruding portion 151*c* is positioned in the inside and vicinity of leg portion 152*a* of the extension tray 152 as shown in FIG. 7.

The protruding portion 151*c* has a restricting surface 151*c*1 which restricts the bending inward of the leg portion 152*a* of the extension tray 152 (in the direction of the arrow in FIGS. 4A and 4B). As a result, in the state in which the slide tray 151 is completely drawn out, even if it is attempted to deform and move the leg portion 152*a* of the attached extension tray 152 inward, the movement of the leg portion 152*a* is restricted by abutting against the restricting surface 151*c*1. Therefore, in the state in which the slide tray 151 is fully drawn out, the attached extension tray 152 will not disengage.

The movement of the extension tray 152 in the vertical direction is restricted by the extension tray 152 being caught between the upper stacking tray 150 and the slide tray 151 and the movement of the extension tray 152 in the front and rear directions is restricted by the extension tray 152 being caught between the thrust restricting portions 150*e* of the upper stacking tray 150 even when the protruding portion 151*c* is provided. Therefore, the movement of the extension tray 152 is restricted against a force in all directions and the extension tray 152 will not come off due to an external force.

As described above, the attachment of the extension tray 152 is started by bending the leg portions 152*a* of the extension tray 152 in the state where the slide tray 151 is drawn a little (about 25 mm) as shown in FIG. 3B. Then, the leg portions 152*a* of the extension tray 152 are inserted into the gap between the upper stacking tray 150 and the slide tray 151. Thereafter, the attachment of the extension tray 152 is completed by drawing out the slide tray 151 completely. Thus, the extension tray 152 is easy to be attached. In the state in which the extension tray 152 is attached, the protruding portion 151*c* restricts the movement (bend) of the leg portions 152*a* of the extension tray 152 so that the extension tray 152 is not disengaged by an external force. When removing the extension tray 152, it is possible to detach the extension tray 152 in the reverse order of the operations of the above-described attachment. Thus, the extension tray 152 can be easily detached.

When it is attempted that the extension tray 152 be attached after completely pulling out the slide tray 151 from the beginning, the leg portions 152*a* of the extension tray 152 interfere with the protruding portion 151*c* and cannot be attached. Conversely, if the slide tray 151 without the protruding portion 151*c* is to be used, there is a possibility that the slide tray 151 may come off when receiving a force in the direction of the arrow in FIG. 4A after the extension tray 152 has been attached.

Figure 8A:
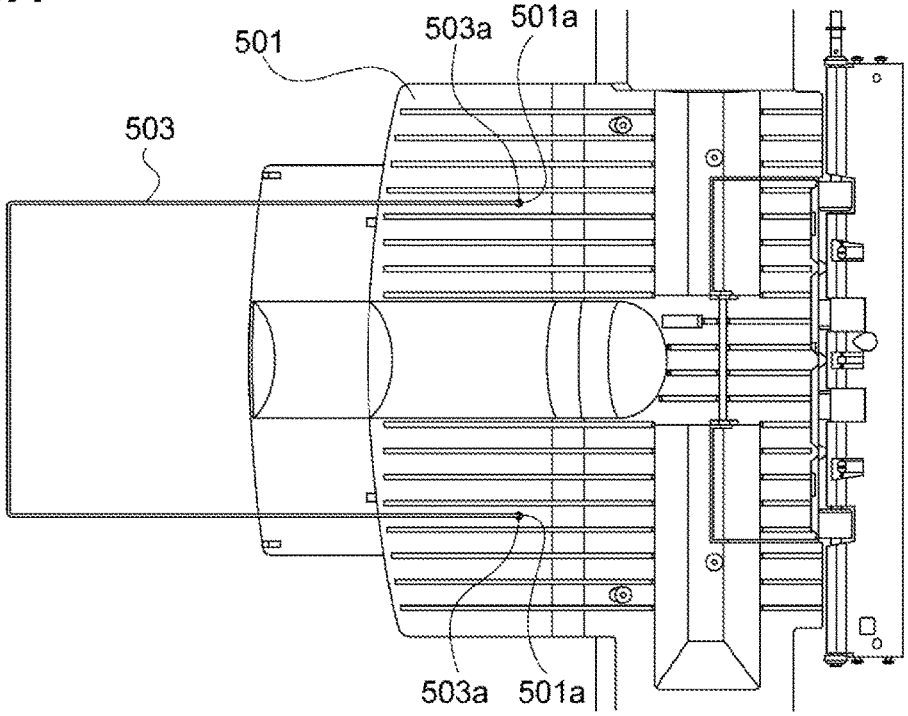
FIGS. 8A and 8B are diagrams for explaining a comparative example.
Figure 8B:
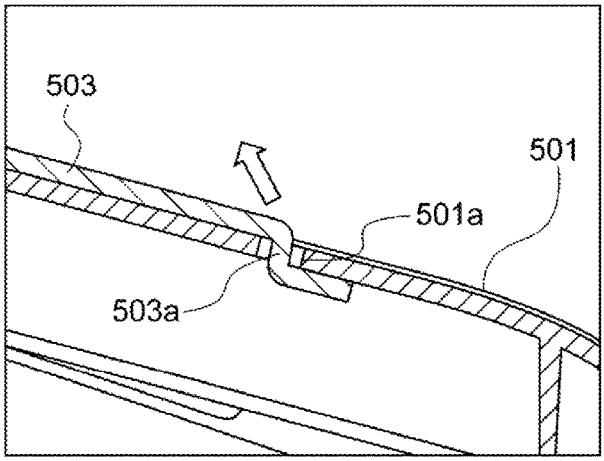

In addition, as shown in FIGS. 8A and 8B, the structure is conceivable in which the extension tray 503 made of a wire rod is inserted into the stacking tray 501 instead of the configuration in which the restricting portion is provided as in the present embodiment. In this structure, the extension tray 503 is attached by inserting the inserting portion 503*a* of the extension tray 503 into the hole 501*a* formed in the stacking tray 501. As shown in FIG. 8B, the inserting portion 503*a* has a stepped shape. Therefore, the movement of the extension tray 503 is restricted in the state where the extension tray 503 is attached.

In the above structure, the extension tray 503 can be attached by inserting the tip of the wire rod member into the hole portion 501*a*, and the extension tray 503 can be detached by pulling it out from the hole 501*a*.

However, in the configuration of FIGS. 8A and 8B, when a force is applied at the time of use in the direction of the arrow in FIG. 8B, which is opposed to the attaching direction, the extension tray 503 may easily disengage. When the gap between the brim of the hole 501*a* and the inserting portion 503*a* is made smaller in order to make the extension tray 503 hard to disengage, it becomes hard to attach the extension tray 503. Also, if the extension tray 503 is secured with screws or the like after the attachment, the extension tray 503 will not disengage at the time of use, but the screws must be attached and detached at the time of attachment and detachment of the extension tray, which deteriorates the workability in the attachment and the detachment of the extension tray.

Figure 9A:
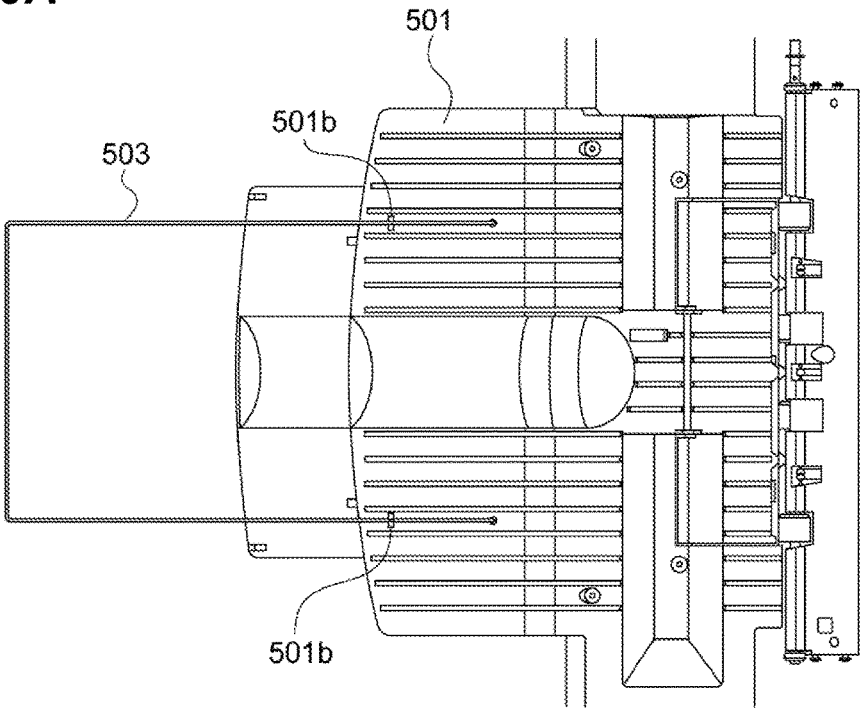
FIGS. 9A, 9B and 9C are diagrams for explaining another comparative example.
Figure 9B:
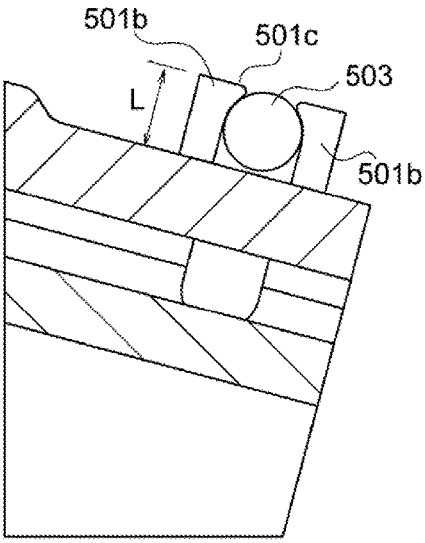
Figure 9C:
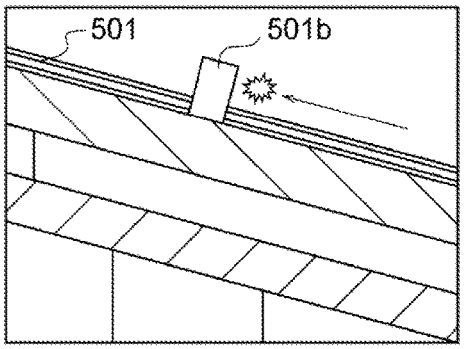

Further, as shown in FIGS. 9A, 9B and 9C, a configuration in which the attachment is made by snap fit is conceivable. FIG. 9A is a diagram as viewed from the stacking surface side, and FIG. 9B is a diagram showing an enlarged cross sectional view of the snap-fit portion.

As shown in FIG. 9B, the snap fit portion 501*b* having an elastically deformable entrance portion is provided at a predetermined position of the stacking tray 501 and the extension tray 503 is attached by fitting the extension tray 503 made of a wire rod in the snap fit portion 501*b*.

In the configuration shown in FIGS. 9A, 9B and 9C, since the attached extension tray 503 is fixed to the snap fit portion 501*b*, the possibility that the extension tray 503 disengages at the time of use is little. However, since the portion of the arm that nips the wire rod member (the portion L shown in FIG. 9B) is short and the snap fit portion 501*b* has a little bend amount, the tip portion 501*c* of the snap fit portion 501*b* will be scraped off when the extension tray 503 is detached. As a result, when the extension tray 503 is detached several times, the tip portion 501*c* disappears, and the function of preventing the extension tray 503 from disengaging may be impaired.

When the sheet processing apparatus 400 is used with the extension tray 503 being detached, the snap fit portion 501*b* protrudes from the stacking surface as shown in FIG. 9C. As a result, there is a possibility that conveyance failure or loading failure occurs since the leading end of a sheet collides with the snap fit portion 501*b*.

In contrast to the configurations of the comparative examples shown in FIGS. 8A, 8B, 9A, 9B and 9C, in the present embodiment, the attached extended tray 152 will not come off in the state in which the slide tray 151 is drawn out.

As described above, in the sheet stacking apparatus of the present embodiment, the slide tray 151 is made slidable such that the slide tray 151 is located at the non-restricting position (the position in FIG. 3) where the protruding portion 151*c* does not restrict the attaching and detaching of the extension tray 152 and at the restricting position (the position shown in FIGS. 6A, 6B, and 7) where the disengagement of the attached extension tray 152 is restricted. This makes it possible to achieve both ease of attaching and detaching of the extension tray 152 and the prevention of disengagement of the attached extension tray 152.

When using long sheets, the extension tray 152 is attached as described above, and the long sheets discharged from the upper stacking tray 150 to the extension tray 152 by the discharge roller 404 are stacked. On the other hand, when not using a long sheet, the extension tray 152 is detached. By using the extension tray 152 in this way, the extension tray 152 can be used only when a long sheet is used, and it is possible to prevent the extension tray 152 from always wastefully occupying the installation area.

Since the protruding portion 151*c* is located inside the surface on which the sheet is stacked even at the position where the extension tray 152 is prevented from coming off, it does not cause troubles such as obstruction of sheet conveyance and marks on the sheets when they are stacked.

Further, as shown in the cross-sectional view of FIG. 6B, the stacking surface of the upper stacking tray 150, the stacking surface of the slide tray 151, and the stacking surface of the extension tray 152 have different angles.

In the case where the angles of the sheet stacking surfaces are different, even when the sheet is in state in which the sheet is bent along the front-back directions (hereinafter referred to as gutter-shaped curl), the gutter-shaped curl can be corrected by bending the sheet in the upstream/downstream direction of conveyance. Therefore, the gutter-shaped curl can be corrected also for a long sheet since the respective stacking surface angles of the upper stacking tray 150, the slide tray 151, and the extension tray 152 are different. For example, when the slide tray 151 and the extension tray 152 have the same angle, the gutter-shaped curl at the upstream side can be removed at the bent portion between the upper stacking tray 150 and the slide tray 151, but the gutter-shaped curl at the downstream side of a long sheet cannot be removed. Therefore, as in the present embodiment, it is preferable that the stacking surface angles of the trays 151, 152 and 153 are different.

The sheet processing apparatus 400 is configured such that the gap between the upper stack tray 150 and the slide tray 151 is smaller when the slide tray 151 is in the stored position in which the slide tray 151 is completely stored in the upper stacking tray 150 than when the slide tray 151 is in the restricting position or the non-restricting position. Therefore, when attaching the extension tray 152, after the slide tray 151 is slightly drawn out in the state shown in FIGS. 3A and 3B, the extension tray 152 is attached.

In this embodiment, the explanation has been made to the case where the extension tray 152 is attached to the upper stacking tray 150. However, the extension tray 152 may be attached to the tray of the lower discharging portion 403 in the same manner or may be attached to both the upper and lower trays. Further, not only on a tray on which sheets on which images are formed are stacked but also on a tray on which sheets to be provided to the image forming portion 304 are stacked, for example, such as the manual feed tray 302 and the slide tray 151 may be slidably provided and the extension tray 152 may be attached in a detachably attachable manner.

The extension tray 162 may be attached to either the upper stacking tray 150 or the slide tray 151.

Second Embodiment

Next, a sheet stacking apparatus according to the second embodiment of the present invention will be explained. In the first embodiment explained above, the extension tray 152 is made of an elastically deformable wire rod member, and the bend of the leg portions of the extension tray 152 is restricted by the restricting portion provided on the slide tray 151. In this embodiment, an example in which the extension tray is made of a plate member will be explained with reference to FIGS. 10 to 12.

Figure 10A:
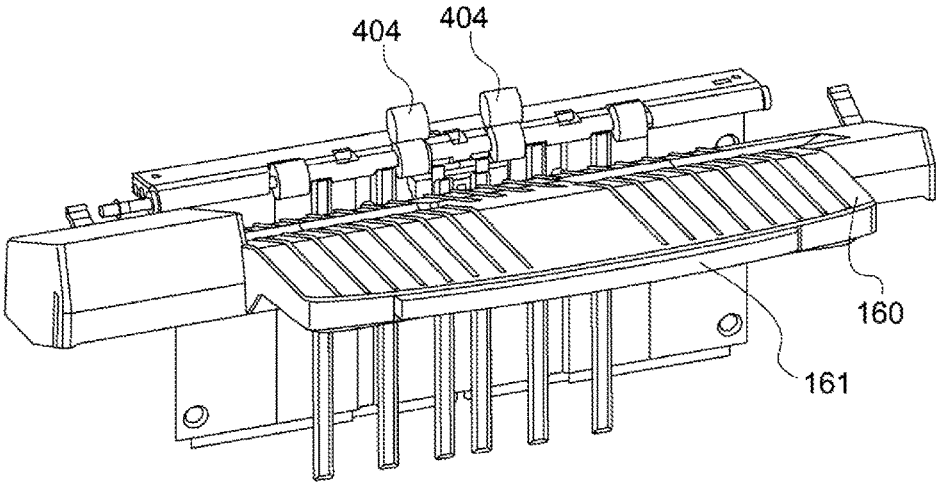
FIGS. 10A and 10B are explanatory diagrams showing a case where an extension tray according to the second embodiment is attached.
Figure 10B:
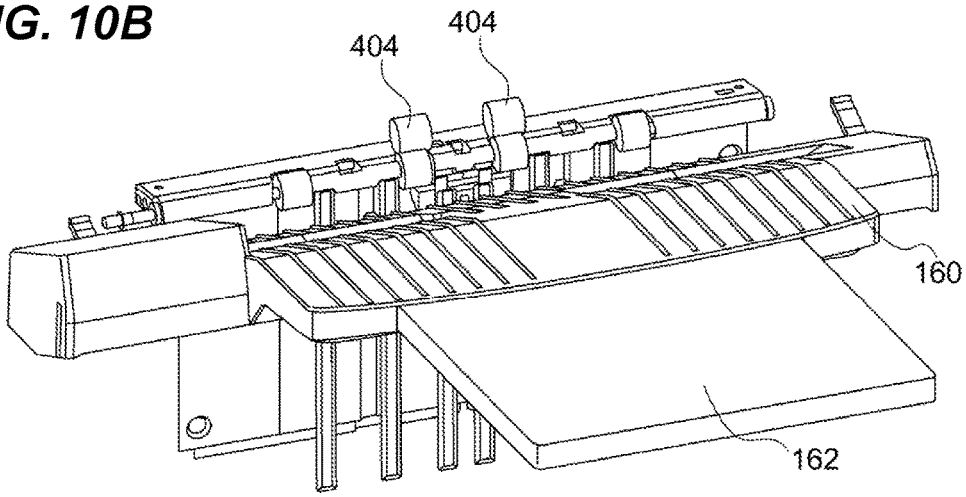

In the sheet stacking apparatus of this embodiment, as shown in FIG. 10A, the slide tray 161 which is the second stacking portion is slidably attached to the stacking tray 160 which is the first stacking portion. FIG. 10A shows the state in which the slide tray 161 is stored in the stacking tray 160. FIG. 10B shows the state in which the extension tray 162 which is the third stacking portion is attached. The extension tray 162 of the present embodiment is a molded plate-shaped tray and is attached by inserting the extension tray 162 into the gap between the stacking tray 160 and the slide tray 161.

Figure 11:
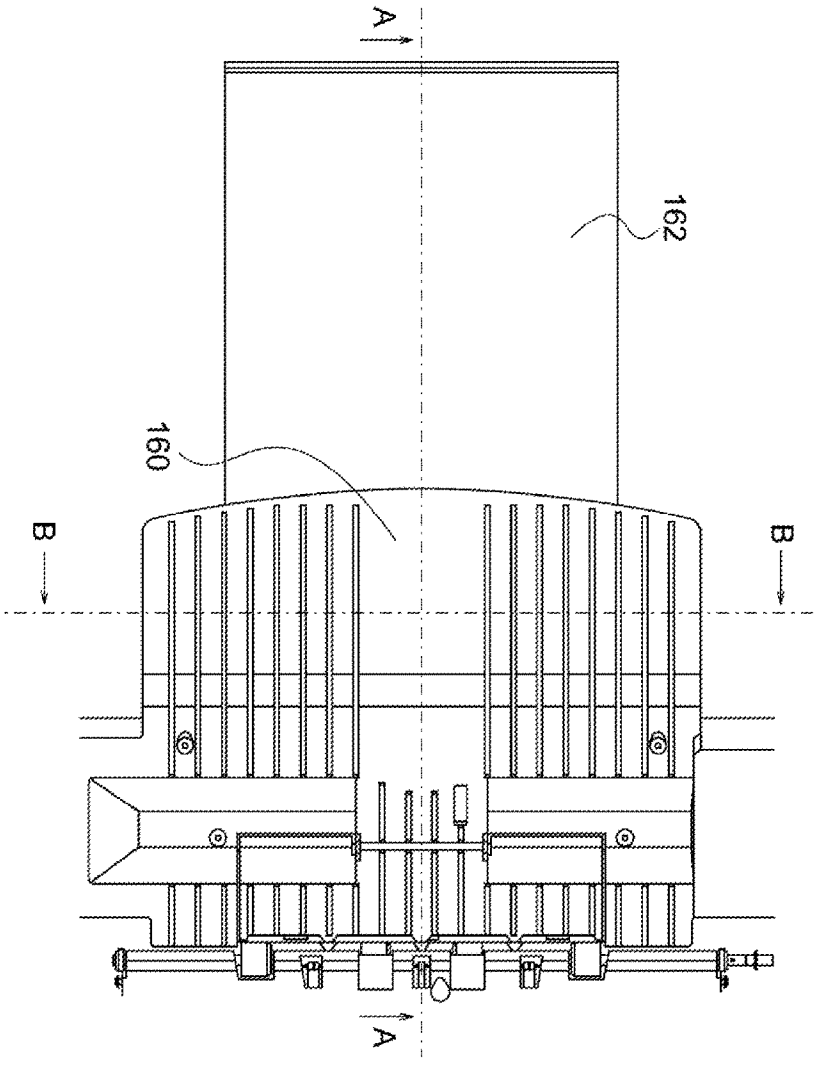
FIG. 11 is an explanatory diagram showing the state in which an extension tray according to the second embodiment is attached.
Figure 12:
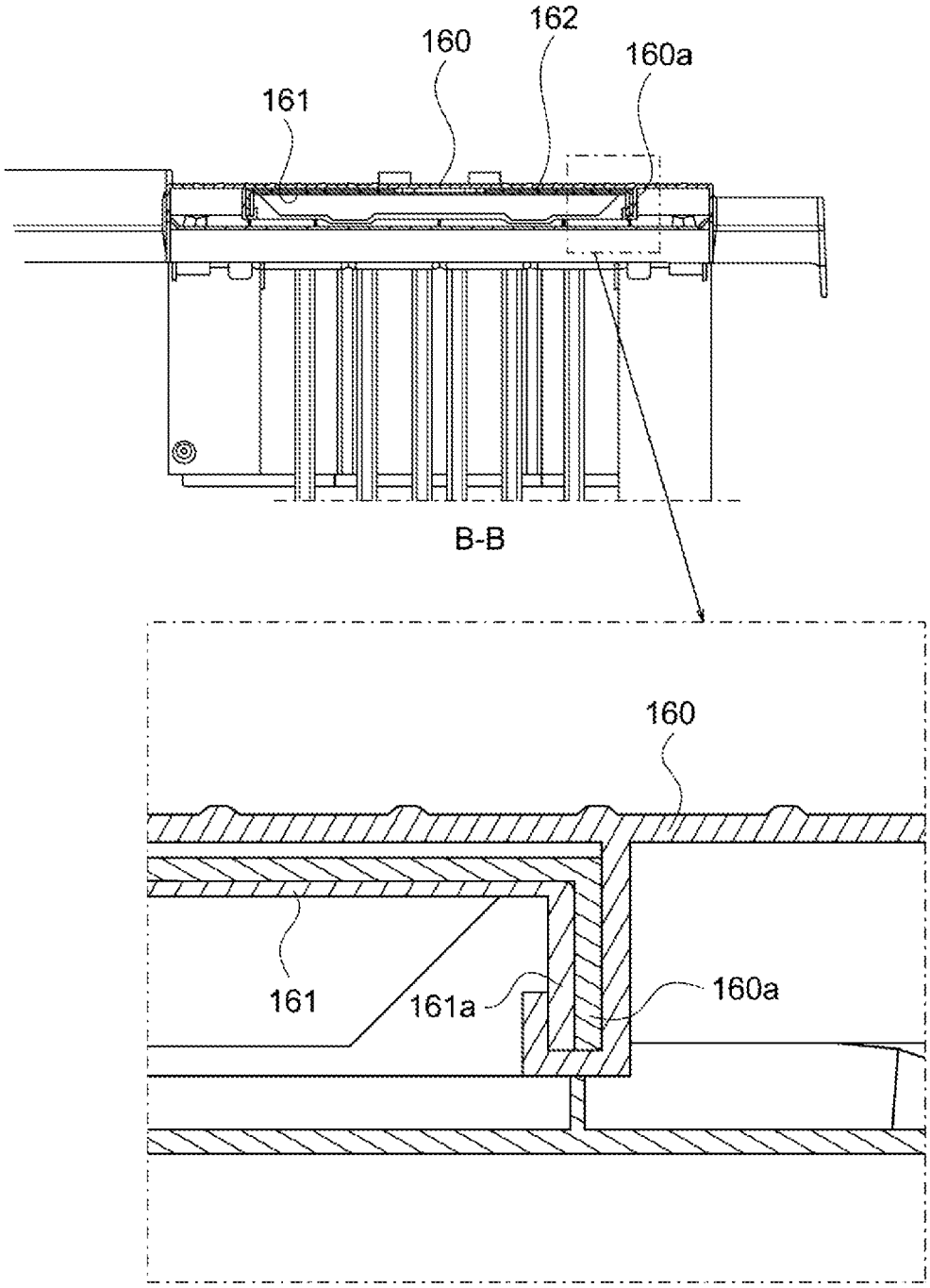
FIG. 12 is an explanatory diagram showing the attaching of a slide tray and the extension tray according to the second embodiment.

FIG. 11 is a diagram showing a view of the state where the extension tray 162 is attached as viewed from the stacking surface side, and FIG. 12 is a diagram showing a cross-sectional view taken along the line B-B in FIG. 11. As shown in FIG. 12, the J-shaped rail portion 160*a* is oppositely arranged on the lower surface of the stacking tray 160 and the leg portions 161*a* formed at both sides of the slide tray 161 in the sheet width direction (the direction perpendicular to the sheet conveying direction) engage slidably with the rail portion 160*a*. The extension tray 162 is attached by inserting the extension tray 162 into the gap between the stacking tray 160 and the slide tray 161.

As a result, the movement of the slide tray 161 in the vertical direction and in the front-rear direction is restricted by the stacking tray 160. Further, the extension tray 162 is nipped between the stacking tray 160 and the slide tray 161 so that the movement of the extension tray 162 in the vertical direction and the front-rear directions is restricted.

Figure 13:
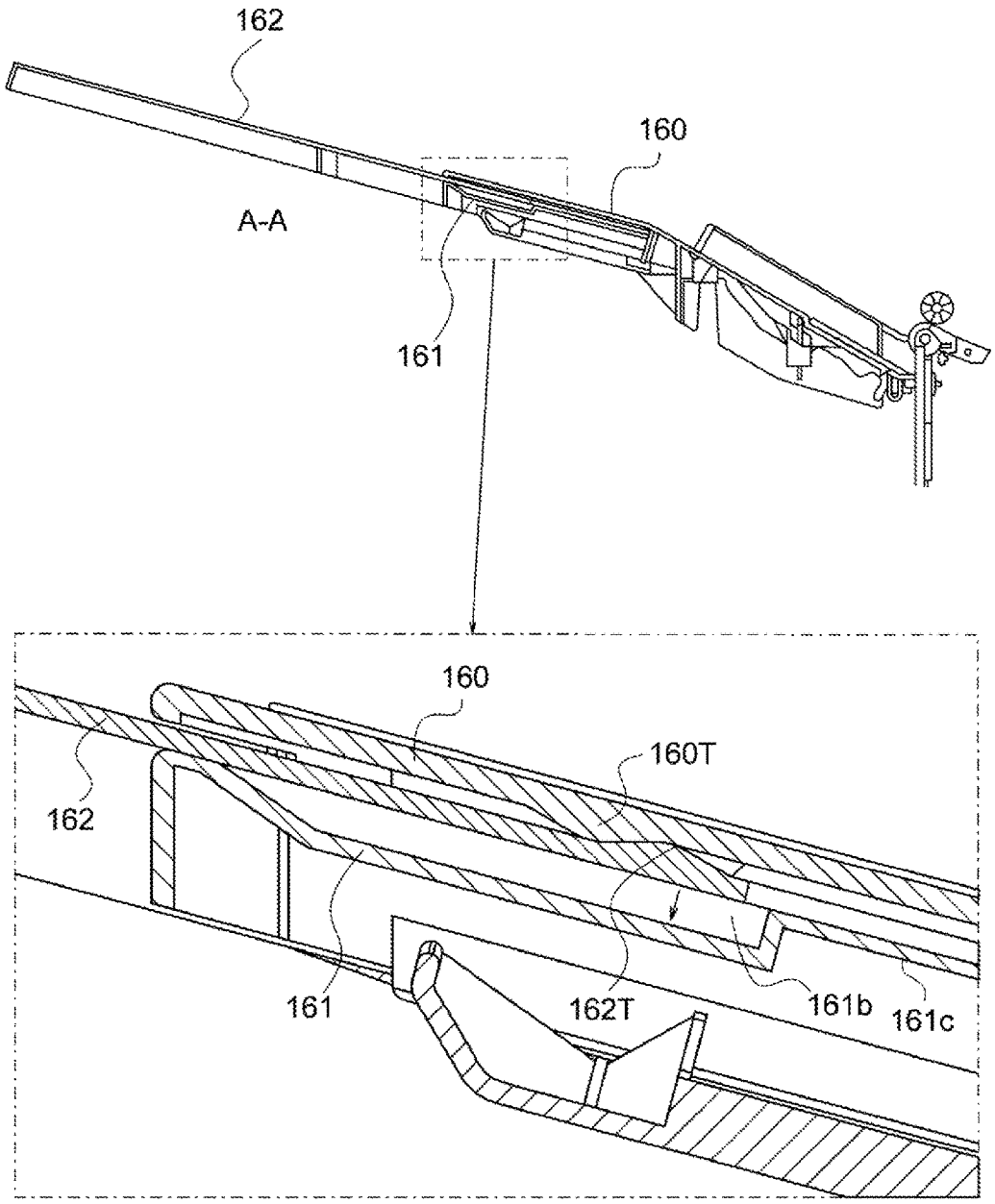
FIG. 13 is an explanatory diagram showing the attaching of the extension tray according to the second embodiment.

FIG. 13 is a diagram showing a cross-sectional view taken along line A-A in FIG. 11. As shown in the partially enlarged view of FIG. 13, the projection portion 160T is formed to serve as an engaging portion, which protrudes downward at a predetermined position on the lower surface of the stacking tray 160. On the other hand, the projection portion 162T which protrudes upward and serves as an engaged portion which can be engaged with the projection portion 160T is formed on the extension tray 162. Further, a step portion is formed at a predetermined position on the slide tray 161 so that there are the escape portion 161*b* where a gap is formed between the extension tray 162 and the slide tray 161 and the abutting portion 161*c* where a gap is not formed.

When attaching the extension tray 162, the extension tray 162 is inserted into the gap between the stacking tray 160 and the slide tray 161 with the slide tray 161 being stored in the stacking tray 160. Then, as shown in FIG. 13, the projection portion 162T of the extension tray 162 is inserted to a position where the projection portion 162T goes over the projection portion 160T of the stacking tray 160. At this time, the projection portion 162T of the extension tray 162 easily goes over the projection portion 160T of the stacking tray 160 since the projection portion 162T of the extension tray 162 is bent in the direction of the arrow in FIG. 13 and the escape portion 161*b* of the slide tray 161 is positioned below the projection portion 160T and the projection portion 162T escapes in the escape portion 161*b* of the slide tray 161.

Figure 14:
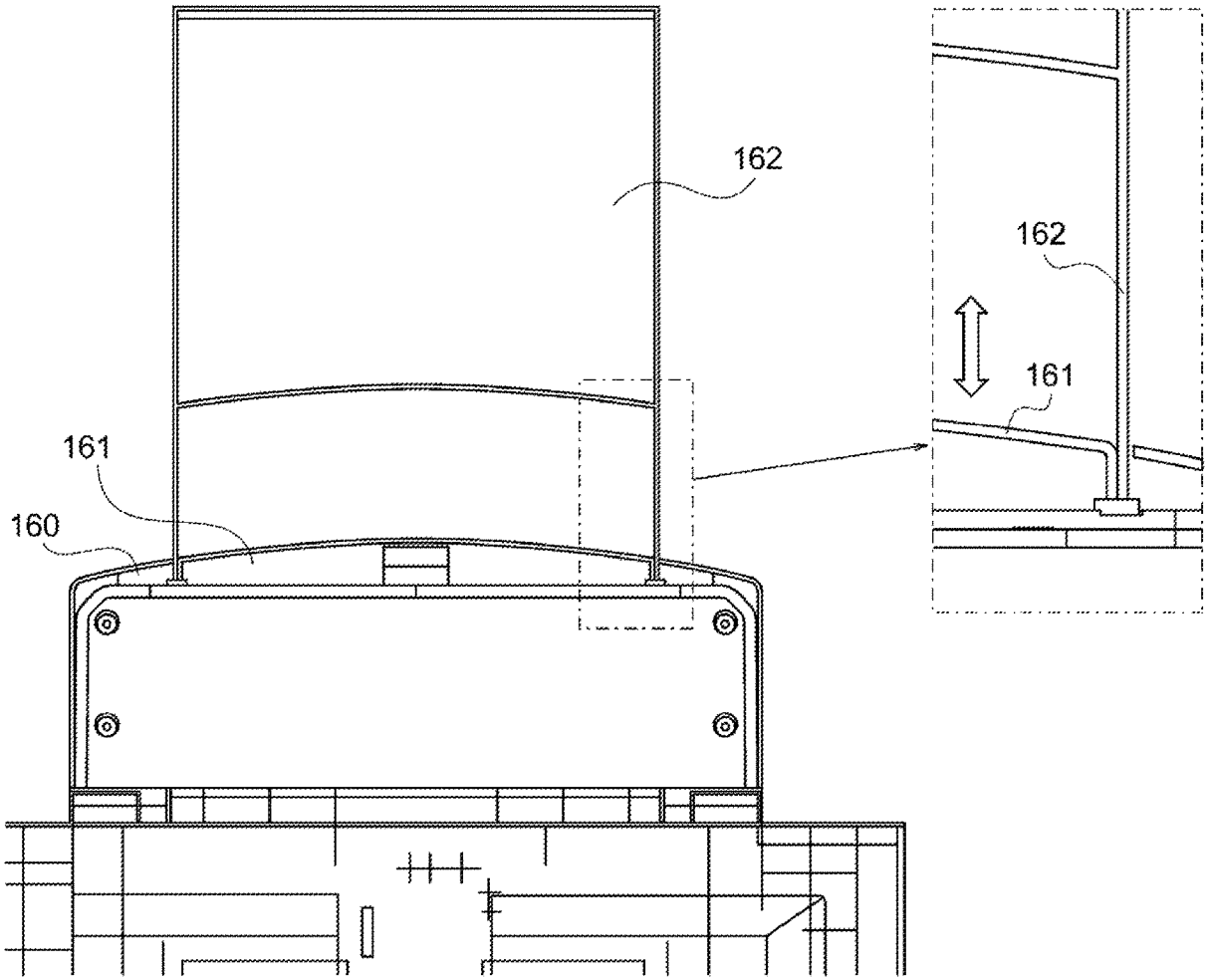
FIG. 14 is an explanatory diagram showing the attaching of the extension tray according to the second embodiment.

FIG. 14 is a diagram showing members of the slide tray 161 and the extension tray 162 as viewed from the back side of the stacking surface. The slide tray 161 is a member that is slidable in the direction of the arrow, but in the state of FIG. 14, the slide tray 161 is stored in the stacking tray 160.

Figure 15:
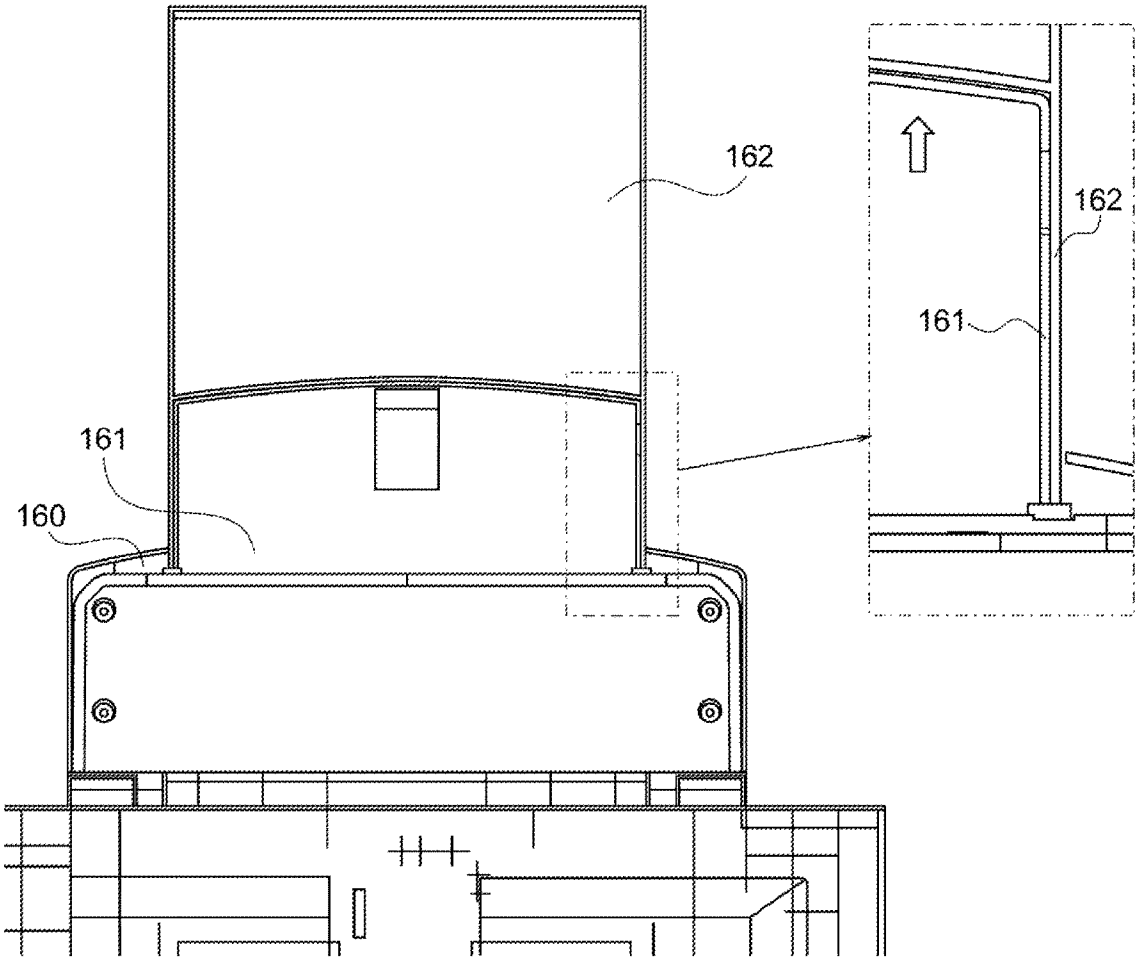
FIG. 15 is an explanatory diagram showing the attaching of the extension tray according to the second embodiment.
Figure 16:
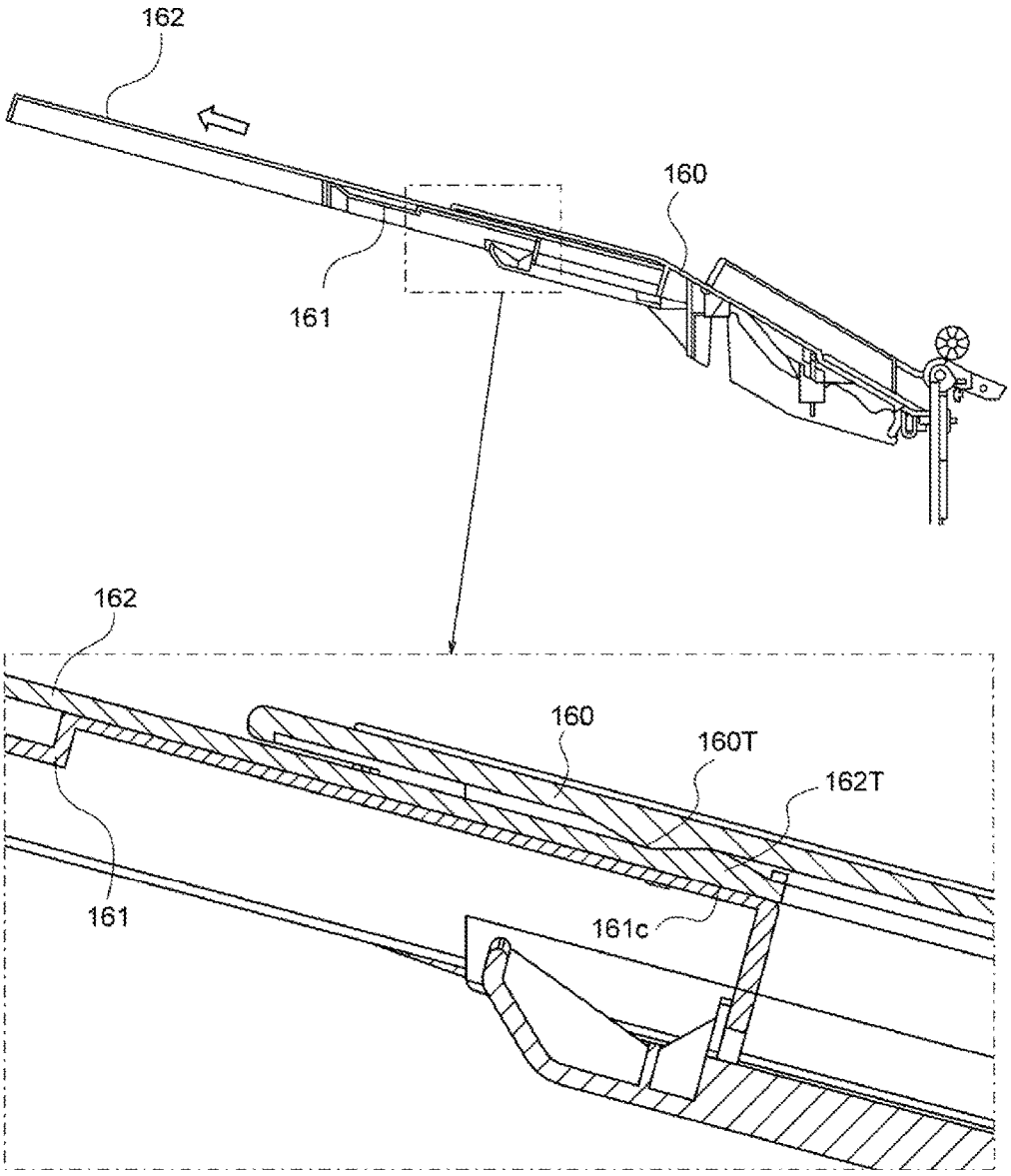
FIG. 16 is an explanatory diagram showing a configuration for restricting the detaching of the extension tray according to the second embodiment.

The slide tray 161 is drawn out from the provisionally attached state. FIG. 15 shows the state after the slide tray 161 is drawn out in the direction of the arrow. FIG. 16 is a cross-sectional view taken along the line A-A in FIG. 11A when the slide tray 161 is drawn out.

As shown in FIG. 16, when the slide tray 161 is drawn out, the abutting portion 161*c* as a restricting portion formed on the slide tray 161 moves to the position where the abutting portion 161*c* is opposed to the projection portion 160T of the stacking tray 160. Therefore, the back portion of the projection portion 162T of the extension tray 162 comes into contact with the abutting portion 161*c*. When the abutting portion 161*c* is in contact with the back portion of the projection portion 162T, the projection portion 162T cannot be bent in the escaping direction (direction of the arrow in FIG. 13). That is, when the slide tray is at the drawn-out position, the abutting portion 161*c* restricts the movement of the attached extension tray 162 in the direction of disengagement. Accordingly, even if the extension tray 162 is pulled in the drawing direction (the direction of the arrow in FIG. 16), the release of the engagement of the projection portion 162T from the projection portion 160T of the stacking tray 160 is restricted so that the projection portion 162T does not disengage from the projection portion 160T. Even in this configuration, the movement of the extension tray 162 in the vertical direction and the front-rear directions is restricted by the extension tray 162 being caught between the stacking tray 160 and the slide tray 161 as shown in FIG. 12.

In removing the extension tray 162, when the slide tray 161 is pushed into the stacking tray 160 to make it in the storage state, the escape portion 161*b* reaches the position of the projection portion 160T as shown in FIG. 13. As a result, the engagement of the projection portions 160T and 162T can be released so that the extension tray 162 can be drawn out in the same manner as at the time of attachment.

The slide tray 161 is movable between the non-restricting position where the projection portion 161*c* does not restrict the attaching and detaching of the extension tray 162 and the restricting position where the disengaging of the attached extension tray 162 is restricted. Therefore, when the slide tray 161 is stored in the stacking tray 160 as shown in FIG. 13, the extension tray 162 can be freely inserted and removed, and when the slide tray 161 is drawn out as shown in FIG. 16, the movement of the extension tray 162 in every direction is restricted so that the extension tray 162 will not disengage.

Therefore, when a user wishes to change a state between the state where a long sheet is used and the state where a long sheet is not used, i.e. when a user wishes to attach or detach the extension tray 162, the user moves the slide tray 161 to the storage position (the position in FIG. 13). On the other hand, when a long sheet is discharged and stacked, i.e., when the extension tray 162 should not be disengaged, the slide tray 161 is moved to the drawn-out position (the position in FIG. 16) after the extension tray 162 has been attached. In this manner, depending on the position of the slide tray 161, it is possible to achieve both the state in which the extension tray 162 can be inserted or drawn out and the state in which the extension tray 162 cannot be disengaged.

Third Embodiment

Next, a sheet stacking apparatus according to the third embodiment of the present invention will be described with reference to FIGS. 17A, 17B, 17C, 18 and 19. In the sheet stacking apparatus of the present embodiment, a restricting portion for restricting the disengagement of the attached third stacking portion is provided on a stacking tray as the first stacking portion.

Figure 17A:
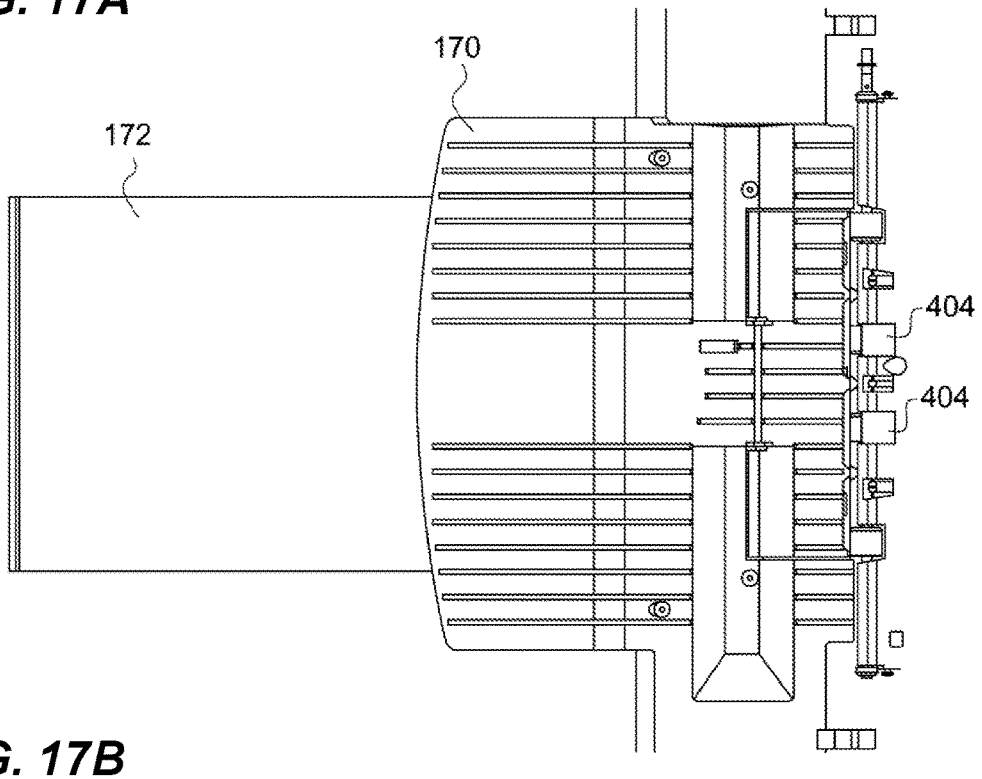
FIGS. 17A, 17B and 17C are explanatory diagrams showing the state in which an extension tray according to the third embodiment is attached.
Figure 17B:
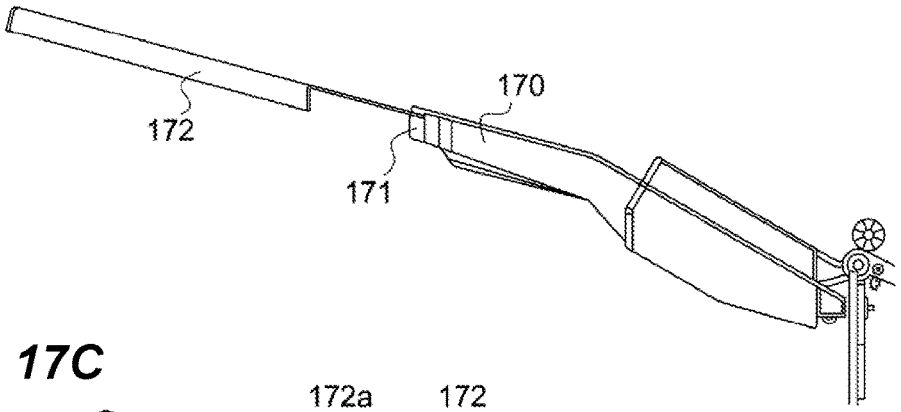
Figure 17C:
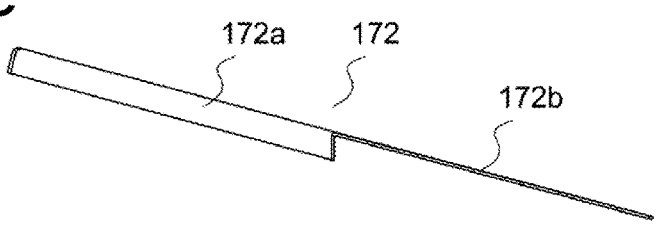

FIG. 17A shows the state according to the third embodiment, in which the extension tray 172 which is the third stacking member is inserted between the stacking tray 170 which is the first stacking member and the slide tray 171 which is the second stacking member as viewed from the stacking surface. FIG. 17B is a diagram showing a bottom view thereof and FIG. 17C is a diagram showing a view of the extension tray 172 alone. Further, FIG. 18 is a diagram showing a view of the state where the extension tray 172 is inserted as shown in FIG. 17A as viewed from the back side of the stacking surface.

As shown in FIG. 17C, the inserting portion 172*b* is formed in a thin plate shape on the upstream side of the stacking portion 172*a* of the extension tray 172. The extension tray 172 can be attached by inserting the inserting portion 172*b* in the gap between the stacking tray 170 and the slide tray 171.

Figure 18:
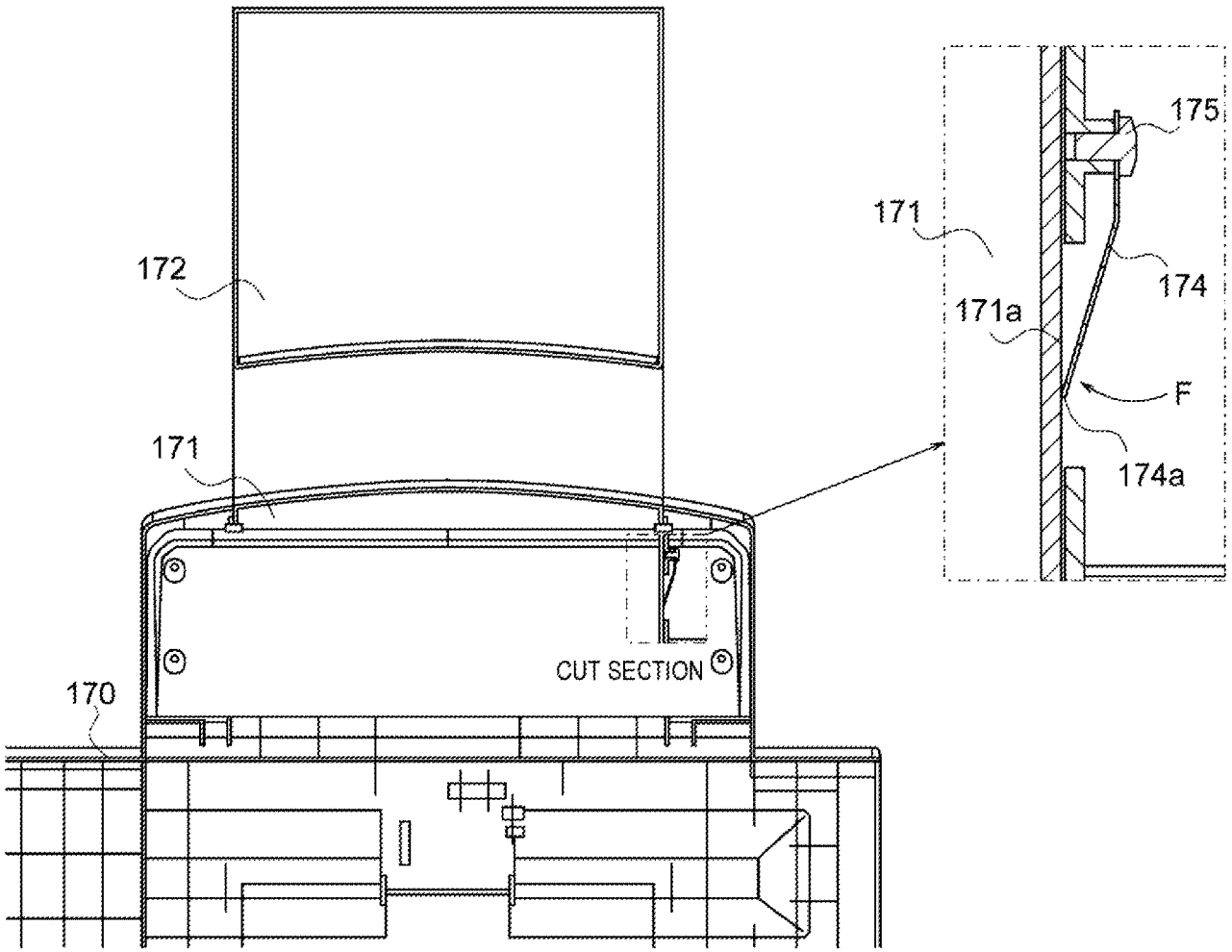
FIG. 18 is an explanatory diagram of the configuration for the restricting of the detaching of the extension tray according to the third embodiment.

Further, as shown in the partially enlarged view of FIG. 18, a restricting member 174 as a restricting portion for restricting the disengagement of the extension tray 172 is attached to the stacking tray 170 by the screw 175.

The restricting member 174 is a plate-like elastically deformable member having spring-like property. As shown in FIG. 18, when the slide tray 171 is stored in the stacking tray 170, the restricting member 174 is urged by the force F in the direction of the arrow as shown in FIG. 18 and the tip portion 174*a* abuts against the side surface 171*a* of the slide tray 171. Since the force F by the restricting member 174 is not strong, the slide tray 171 can slide between the storage position and the drawn-out position with the tip portion 174*a* being in contact with the side surface 171*a*.

Further, the size of the extension tray 172 in the sheet width direction is substantially the same as that of the slide tray 171, so the extension tray 172 does not protrude from the side of the slide tray 171. Therefore, in the state in which the slide tray 171 is in the storage position as the non-restricting position and the tip portion 174*a* of the restricting member 174 is in contact with the side surface 171*a* of the slide tray 171, the extension tray 172 can be inserted and drawn out without being in contact with the restricting member 174.

Figure 19:
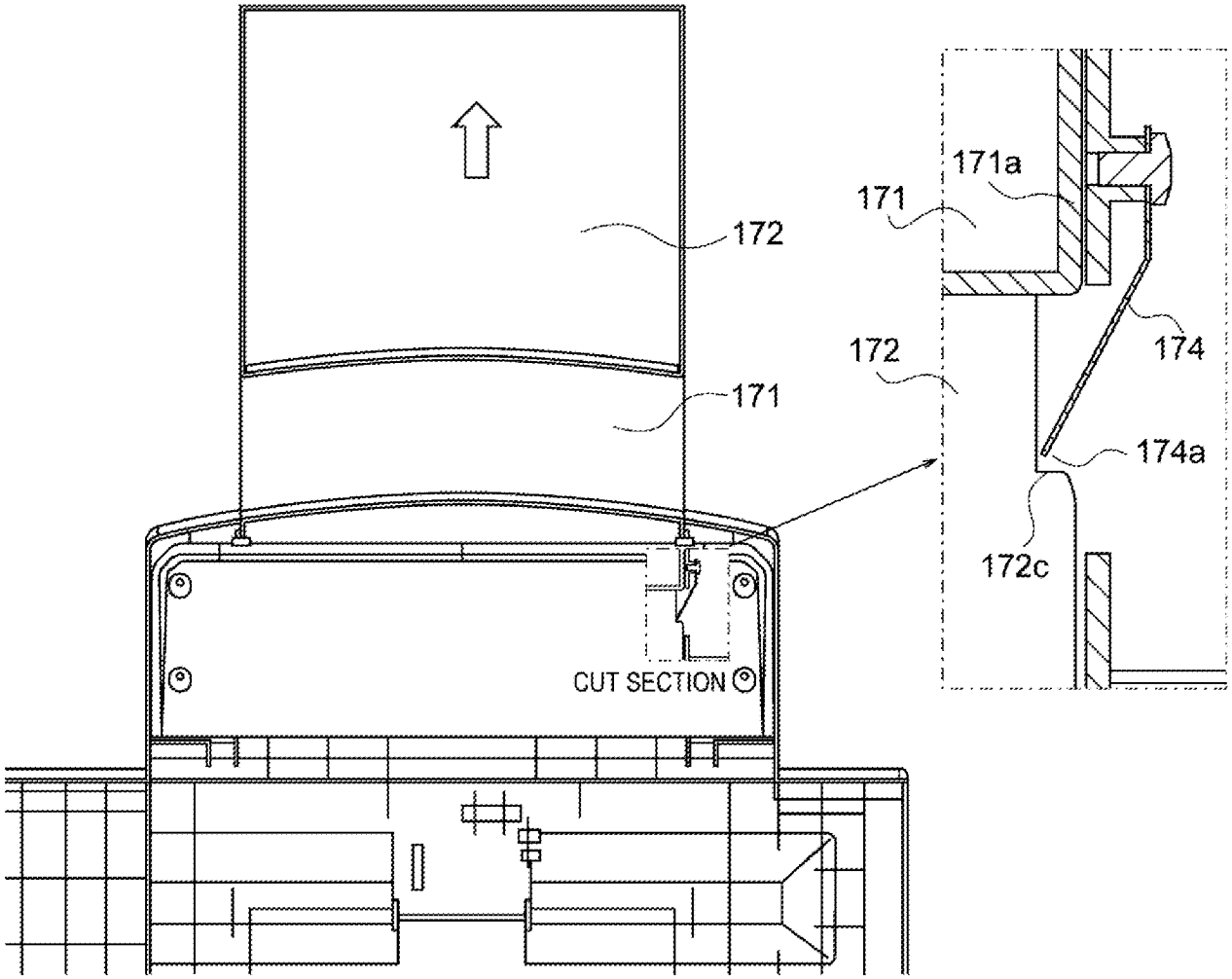
FIG. 19 is an explanatory diagram of the configuration for the restricting of the detaching of the extension tray according to the third embodiment.

FIG. 19 is a diagram showing a view of the slide tray 171 in the state where the slide tray 171 is drawn out as viewed from the back side of the stacking surface. As shown in FIG. 19, the holding portion 172*c* as a cut out engaging portion is formed at a position which is located on the side surface of the extension tray 172, which is farther in the insertion direction with respect to the tip portion 174*a* of the restricting member 174 when the extension tray 172 is attached. The holding portion 172*c* is provided at the position where the holding portion 172*c* can be engaged with the tip portion 174*a* when the slide tray 171 is drawn out and the side surface 171*a* moves to a position where the side surface 171*a* is not in contact with the tip portion 174*a* of the restricting member 174 and the force F of the restricting member 174 is released and the tip portion 174*a* goes farther in the inside direction than the side surface 171*a*.

That is, as shown in FIG. 19, when the slide tray 171 moves in the downstream direction, the tip portion 174*a* is not in contact with the side surface 171*a* since the slide tray 171 is not in a position where the slide tray 171 is in contact with the tip portion 174*a*. When the side surface 171*a* is not at a position where the side surface 171*a* is in contact with the tip portion 174*a*, the force F of the restricting member 174 is released and the tip portion 174*a* of the restricting member 174 goes farther in the inside direction and the tip portion 174*a* moves into the neighborhood of the holding portion 172*c* of the extension tray 172. In this state, even when a force for disengaging the extension tray 172 (a force in the direction of the arrow in FIG. 19) is applied, the extension tray 172 does not disengage since the tip portion 174*a* abuts against the holding portion 172*c*.

That is, as shown in FIG. 18, when the slide tray 171 is in the non-restricting position, i.e., the position where the slide tray 171 is stored in the stacking tray 170, the tip portion 174*a* is in contact with the side surface 171*a* and not in contact with the holding portion 172*c* of the extension tray 172 so that the extension tray 172 can be freely inserted and drawn out. On the other hand, as shown in FIG. 19, when the slide tray 171 is at the restricting position where the slide tray 171 is drawn out, the tip portion 174*a* is in the vicinity of the holding portion 172*c* of the extension tray 172 and even if such a force in the direction of the arrow is applied that the extension tray 172 is disengaged, the tip portion 174*a* restricts the movement of the holding portion 172*c* so that the extension tray 172 does not disengage.

As described above, when the slide tray 171 is stored, the extension tray 172 can be detached and when the extension tray 172 is drawn out, the extension tray 172 does not disengage. Accordingly, the extension tray 172 can be inserted or drawn out into or from the sheet stacking apparatus while the disengagement of the extension tray 172 can be avoided when the extension tray 172 is used.

Further, a user can use the extension tray for a long sheet only when the user wishes to use the extension tray and it is possible to prevent the long extension tray from unnecessarily occupying the place when the extension tray is not used. Furthermore, the extension tray does not disengage when it is used.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2016-038572, filed Mar. 1, 2016, which is hereby incorporated by reference herein in its entirety.

What is claimed is:

1. A sheet stacking apparatus, comprising:

a first stacking portion on which a sheet is stacked;

a second stacking portion on which a sheet is stacked, the second stacking portion being movable to a first position and a second position with respect to the first stacking portion;

an extension stacking member on which a sheet is stacked, the extension stacking member being detachably attachable to the first stacking portion or the second stacking portion; and a restricting portion configured to restrict the extension stacking member which has been attached, wherein an area on which the sheet is configured to be stacked in a case that the second stacking portion is located at the second position and the extension stacking member is not attached is broader than an area on which the sheet is configured to be stacked in a case that the second stacking portion is located at the first position and the extension stacking member is not attached, wherein an area on which the sheet is configured to be stacked in a case that the extension stacking member is attached is broader than an area on which the sheet is configured to be stacked in a case that the extension stacking member is not attached, wherein the restricting portion allows the extension stacking member which has been attached to be detached from the first stacking portion or the second stacking portion and also allows the extension stacking member to be attached to the first stacking portion or the second stacking portion, when the second stacking portion is located at the first position, and wherein the restricting portion restricts the extension stacking member which has been attached so as not to be removed from the first stacking portion or the second stacking portion, when the second stacking portion is located at the second position.

2. The sheet stacking apparatus according to claim 1, wherein the second stacking portion is provided on the first stacking portion such that the second stacking portion is slidable in a direction in which a sheet stacking surface extends.

3. The sheet stacking apparatus according to claim 1, wherein the restricting portion is provided on the second stacking portion.

4. The sheet stacking apparatus according to claim 3, wherein the extension stacking member is made of an elastically deformable wire rod member, and wherein the restricting portion includes a protruding portion which restricts deformation of the wire rod member when the second stacking portion is located at the second position.

5. The sheet stacking apparatus according to claim 3, wherein the first stacking portion includes an engaging portion, wherein the extension stacking member includes an engaged portion which can be engaged with the engaging portion, and wherein the restricting portion which is provided on the second stacking portion restricts release of engagement of the engaging portion with the engaged portion when the second stacking portion is located at the second position and can release engagement of the engaging portion with the engaged portion when the second stacking portion is located at the first position.

6. The sheet stacking apparatus according to claim 1, wherein the restricting portion is provided on the first stacking portion.

7. The sheet stacking apparatus according to claim 6, wherein the extension stacking member includes an engaging portion which can engage with the restricting portion when the second stacking portion is located at the second position, and which does not engage with the restricting portion when the second stacking portion is located at the first position.

8. The sheet stacking apparatus according to claim 1, wherein the restricting portion does not protrude from a sheet stacking surface.

9. The sheet stacking apparatus according to claim 1, wherein angles of a sheet stacking surface of the first stacking portion, a sheet stacking surface of the second stacking portion, and a sheet stacking surface of the extension stacking member are different from each other.

10. The sheet stacking apparatus according to claim 1, wherein the second stacking portion is movable to a storage position at which the second stacking portion is stored in the first stacking portion.

11. The sheet stacking apparatus according to claim 10, wherein a gap between the first stacking portion and the second stacking portion, formed when the second stacking portion is located at the storage position is smaller than that formed when the second stacking portion is located at the first position or the second position.

12. An image forming apparatus, comprising:

an image forming portion configured to form an image on a sheet; and the sheet stacking apparatus according to claim 1, which is configured to stack a sheet on which an image is formed by the image forming portion.

13. The sheet stacking apparatus according to claim 1, further comprising a discharge portion, wherein a sheet discharged from the discharge portion in a discharging direction is stacked on the first stacking portion and the second stacking portion, and wherein the second position is located on a downstream side of the first position in the discharging direction.

* * * * *